US006276679B1

(12) United States Patent
Joyce et al.

(10) Patent No.: US 6,276,679 B1
(45) Date of Patent: Aug. 21, 2001

(54) FLOATING IDLER PULLEY RETARD SYSTEM FOR MIXED MAIL SEPARATION

(75) Inventors: Steven H. Joyce, Wallingford; James A. Salomon, Cheshire, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/447,148

(22) Filed: Nov. 23, 1999

(51) Int. Cl.[7] ..... B65H 3/04

(52) U.S. Cl. ..... 271/122; 271/35; 271/124; 271/125

(58) Field of Search ..... 271/34, 35, 121, 271/122, 123, 124, 125

(56) References Cited

U.S. PATENT DOCUMENTS

| | | | | |
|---|---|---|---|---|
| 4,772,004 | * | 9/1988 | Golicz | 271/124 X |
| 4,909,499 | * | 3/1990 | O'Brien et al. | 271/122 X |
| 4,978,114 | * | 12/1990 | Holbrook | 271/122 X |
| 5,074,540 | * | 12/1991 | Belec et al. | 271/34 |
| 5,238,236 | * | 8/1993 | Belec et al. | 271/122 X |
| 5,431,385 | * | 7/1995 | Holbrook | 271/122 |
| 6,003,857 | * | 12/1999 | Salomon et al. | 271/122 |
| 6,135,441 | * | 10/2000 | Belec et al. | 271/121 X |

* cited by examiner

*Primary Examiner*—Christopher P. Ellis
*Assistant Examiner*—Patrick Mackey
(74) *Attorney, Agent, or Firm*—Steven J. Shapiro; Michael E. Melton

(57) ABSTRACT

A retard module in a mail separator having a floating, middle idler to change the ingestion angle of the mail separator. The retard module further has a downstream idler, an upstream pulley driven by a motor, and an endless belt forming a loop around the idlers and the pulley to provide a retarding force against a feed module. The downstream portion of the retard belt and the belt of the feed module form a nip to ingest incoming mail. The floating idler and the downstream idler are mounted on a bracket which, in turn, is pivotally mounted on a frame of the retard module. Initially, the ingestion angle at the nip is acute and thereby reduces damage to the incoming mailpieces. But when a thick mailpiece enters the separator, it causes the floating idler to move away further from the feed module and thereby increases the ingestion angle. A large ingestion angle allows thicker mailpieces to pass through the nip without substantially increasing the nipping forces. With the floating idler mounted together with the downstream idler on the pivoting bracket, the endless belt maintains substantially the same length regardless of the ingestion angles. This feature keeps constant tension on the belt and helps prevent the belt from slipping.

14 Claims, 4 Drawing Sheets

FLOATING IDLER PULLEY RETARD SYSTEM FOR MIXED MAIL SEPARATION

TECHNICAL FIELD

The present invention relates generally to a mailpiece separator in a mixed mail feeding system and, more specifically, to a retard module for providing a retarding force against the incoming mailpieces in a mixed mail separator.

BACKGROUND OF THE INVENTION

In a mixed-mail cancellation system, a vertical stack advance is used to move the mail into a nudger which nudges the mail away from the stack advance toward a mail separator. Mail is loaded upside down with the face toward the nudger. This allows cancellation of various sizes of mailpieces without having to shuttle the print head up and down. As the mailpieces are nudged away from the stack advance toward the separator, they are separated by a separation nip so that only one piece of mail at a time is allowed to be transported into the printing area for cancellation. In general, the mail separator includes a retard module and a feed module. The belt on the feed module moves the closest mailpiece downstream toward the printing area, while the belt on the retard module pushes the subsequent mailpieces upstream in order to singulate mailpieces from an incoming stack of mail. The retard module is placed against the feed module at an angle such that the feed belt and the retard belt form an inlet at the upstream end and a nip at the downstream end to ingest incoming mailpieces. The angle at the nip between the feed belt and retard belt is generally referred to as the ingestion angle. It has been found that, on the one hand, if the ingesting angle is too large, the mailpieces are more likely to be damaged at the nip. On the other hand, if the ingesting angle is too acute, it limits a thicker mailpiece to pass through the separator by geometry. In the past, a retard module with two sections has been used to meet these two contradicting requirements. As disclosed in U.S. Pat. No. 5,238,236 (Belec et al.), the retard module includes two sections, an upstream section and a downstream section, each having belts and pulleys for providing retarding forces. The two sections are pivotally connected to allow flexing motion therebetween. With this design, the downstream section which forms the separation nip can have a small ingestion angle to reduce the feeding damage while the upstream section forms a wider inlet with the feed belt. The urging structure enables the two sections to laterally flex about the coupling structure in response to the thickness of incoming mailpieces.

While the two-section design reduces the feeding damage and can accommodate thicker mailpieces, the design is somewhat complex. It is, therefore, desirable to provide a simpler and more cost-effective retard module that can meet the same requirements.

SUMMARY OF THE INVENTION

The present invention provides a retard module in a mailpiece separator to provide a retarding force against the incoming mailpieces, wherein the retard module and a feed module are used to form a separation nip for ingesting the incoming mailpieces, one at a time. The retard module comprises at least one upstream pulley; one middle pulley and one downstream pulley; a frame having an upstream end and a downstream end for rotatably mounting the upstream pulley at the upstream end of the frame; a bracket for rotatably mounting the middle pulley and the downstream pulley, wherein the bracket is pivotally mounted about a pivot point at the downstream end of the frame; and at least one endless belt for driving the upstream pulley, the middle pulley and the downstream pulley; wherein the downstream end of the feed module and the endless belt at the downstream end of the frame form the separation nip and the middle pulley is positioned relative to the feed module to define an ingestion angle, and wherein the bracket allows the middle pulley and the downstream pulley to rotate simultaneously in order to adjust the ingest angle in accordance with the thickness of the mailpiece entering the separation nip.

The middle pulley is located between the first end pulley and the second end pulley, wherein the middle pulley has a first rotating axis and the downstream end pulley has a second rotating axis, and wherein the distance between the first rotating axis and the pivoting point is longer than the distance between the second rotating axis and the pivoting point. When no mailpiece is pushing the endless belt of the retard module, the middle pulley is located adjacent to the feed module and the ingestion angle is smallest. When a mailpiece is pushing the endless belt as it is ingested by the separation nip, the middle pulley is pushed further away from the feed module, thereby widening the ingestion angle. As the pulleys are located within the endless belts and are constrained thereby, the middle pulley is in line with the upstream and downstream pulleys when the middle pulley is pushed furthest from the feed module. In this situation, the ingestion angle is the largest. With the preferred embodiment of the present invention, the smallest ingestion angle is substantially equal to 8 degrees while the largest ingestion angle is substantially equal to 17.1 degrees.

The pivoting bracket allows the middle pulley to be floating within the endless belt, and enables the system to maintain a relatively constant belt length as the pulleys mounted thereon rotate through their operating range as constrained by the endless belt. This feature keeps constant tension on the belt and helps preventing the belt from slipping. The pivoting bracket also allows the mailpiece separator to run at a lower ingestion angle, when compared to prior art retard modules. Also, since the floating middle pulley allows thicker mailpieces to open the separation nip more easily, the separation nip can singulate mixed mailpieces having a very large range of thicknesses.

A lower ingestion angle, for a given nip force, reduces the damage of lightweight mailpieces. The low operable ingestion angle is a major advantage of the floating idler design. Another advantage of this floating idler pulley design is that the pivoting action of the pivoting bracket produces low nip forces at the middle pulley even when a thick mailpiece comes in contact with the middle pulley prior to entering the separation nip. Consequently, the pivoting action of the pivoting bracket decreases the chance of damaging the mailpiece and, at the same time, decreases the amount of force required by the nudger to push the mailpiece into the separation nip. The pivoting action also allows the retard module to close on the trailing edge of a mailpiece and, therefore, to come in contact with the next mailpiece more quickly to begin separation of the next mailpiece.

The present invention and its advantages will become more apparent upon reading the description taken in conjunction with the following drawing figures.

DETAILED DESCRIPTION

Figure 1:
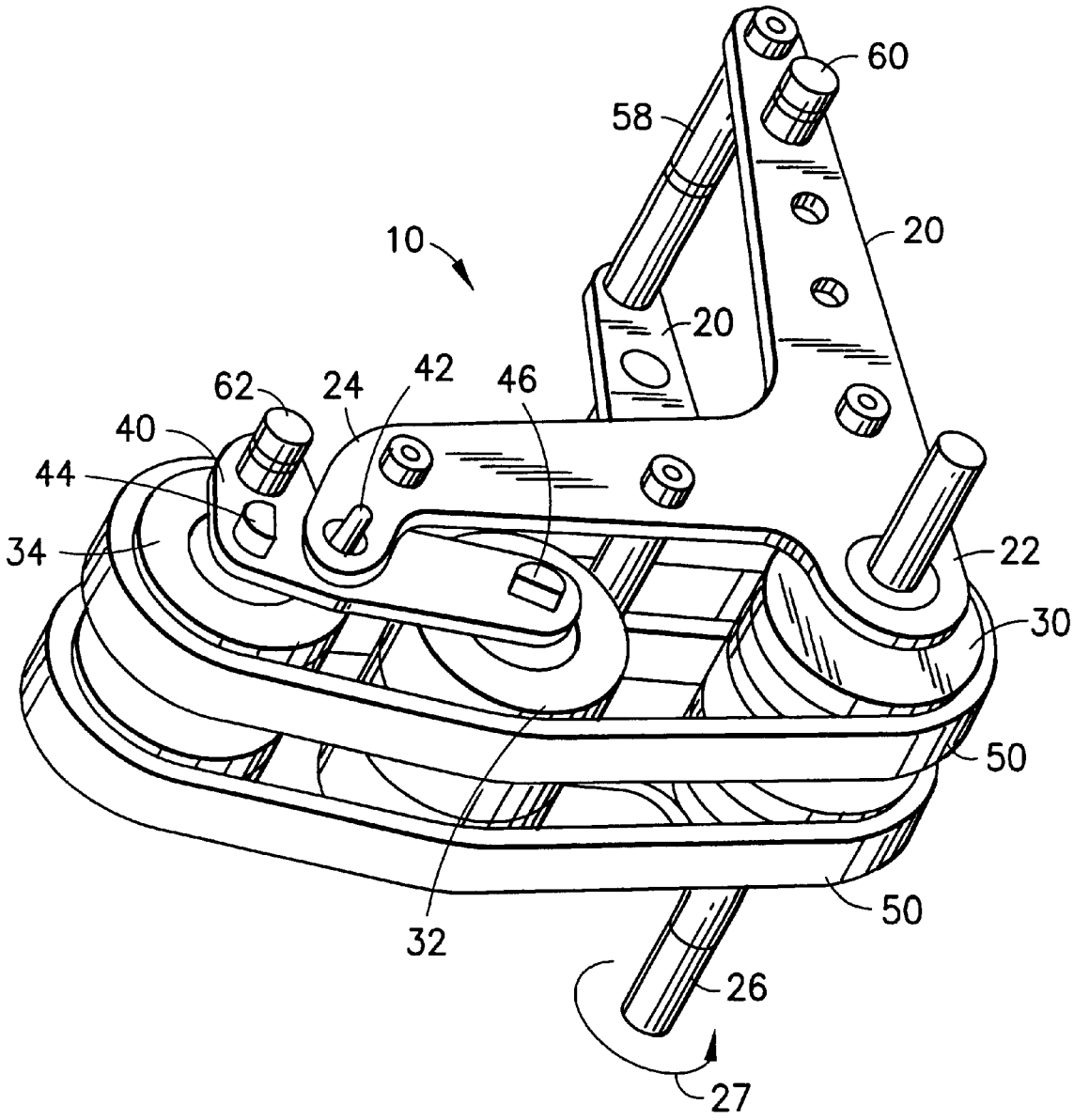
FIG. 1 shows an isometric view of the floating idler pulley retard module, according to the present invention.

FIG. 1 shows an isometric view of the floating idler pulley retard module 10, according to the present invention. As shown, the floating idler pulley retard module 10 includes a frame 20 to support the components of the module. At the upstream end 22 of the frame 20, an upstream pulley 30 is mounted on a drive shaft 26. A downstream pulley 34 and a middle pulley 32 are rotatably mounted, preferably on one or two pivoting brackets 40. The pivoting brackets are pivotally mounted at the downstream end 24 of frame 20 with a pivot pin 42. The upstream pulley 30 is a driven pulley while the downstream pulley 34 and the middle pulley 32 are idlers. The drive shaft 26 also serves as a pivot shaft of frame 20 to be mounted on a mail separator 100 (see FIG. 2). Two endless belts 50 are used to put the pulleys 32 and 34 into motion. The drive shaft 26 is driven by a motor (not shown) in a direction as indicated by an arrow 27 so that the endless belts 50 are running against the incoming mailpieces 120 (see FIG. 2).

As can be seen in FIG. 1, the downstream pulley 34 and the middle pulley 32 can rotate about the pivot pins 42, but their movement and, therefore, their operating range are limited by the endless belts 50. Moreover, it is preferred that the distance between the pivot pin 42 and the rotating axis 44 of the downstream pulley 34 be shorter than the distance between the pivot pin 42 and the rotating axis 46 of the middle pulley 32. This arrangement allows the floating middle pulley 32 to move about a greater range. Like the downstream pulley 34, the middle pulley 32 is an idler.

Figure 2:
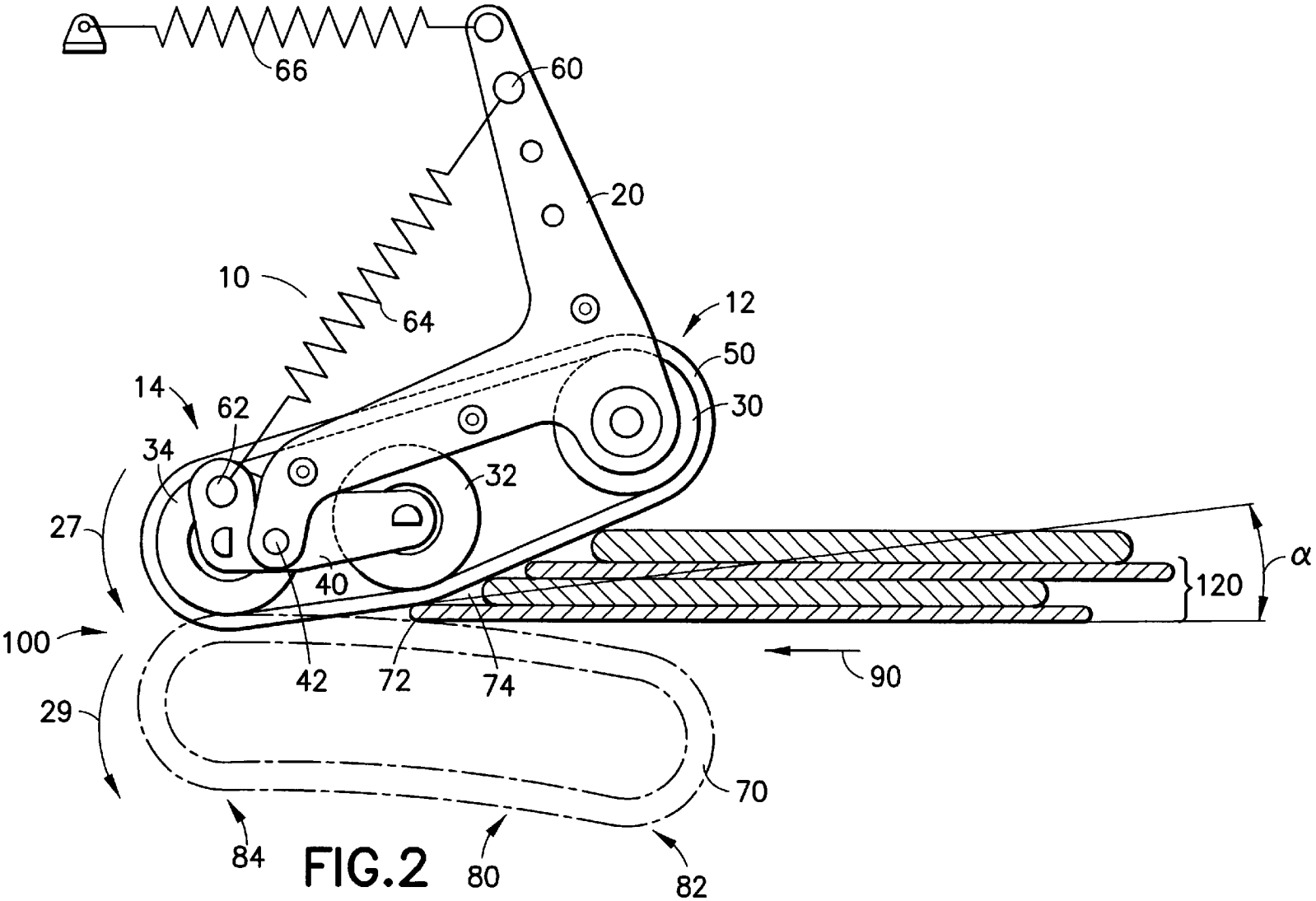
FIG. 2 shows the initial position for the middle pulley.

FIG. 2 shows the initial position for the middle pulley 32. In FIG. 2, there is also shown the would-be position of a feed module 80 having a feed belt 70. Together, the retard module 10 and a feeder module 80 form a mail singulator or separator 100. As shown, the retard module 10 has an upstream end 12 and a downstream end 14, and the feeder module 80 has an upstream end 82 and a downstream end 84. The retard module 10 is arranged such that the endless belts 50 at the downstream end 14 of the retard module 10 and the belt 70 at the downstream end 84 of the feed module 80 form a separation nip 72 to ingest the incoming mailpieces 120. As shown, the mailpieces 120 are coming into the inlet 74 from an upstream direction as indicated by an arrow 90.

As shown in FIG. 2, none of the incoming mailpieces 120 is pushing the endless belts 50, and the middle pulley 32 is said to be in its initial position. In this situation, the ingestion angle $\alpha$ is referred to as the initial ingestion angle and is substantially equal to 8 degrees, according to the preferred embodiment of the present invention. It is understood that the initial ingestion angle $\alpha$ can be smaller or larger than 8 degrees. The ingestion angle $\alpha$, in general, is defined by the angle formed by the endless belt 50 of the retard module 10 and the belt 70 of the feed module 80 at the inlet 74 adjacent to the separation nip 72. Also shown in FIG. 2 is a nip force spring 66 mounted on a retard spring shaft 58 (see FIG. 1) for providing the nip forces for the mail separator 100. Optionally, a tension adjusting spring 64 is mounted on a spring holding pin 60 on the frame 20 and another spring holder pin 62 on the pivoting bracket 40 to adjust the tension of the belts 50.

Figure 3:
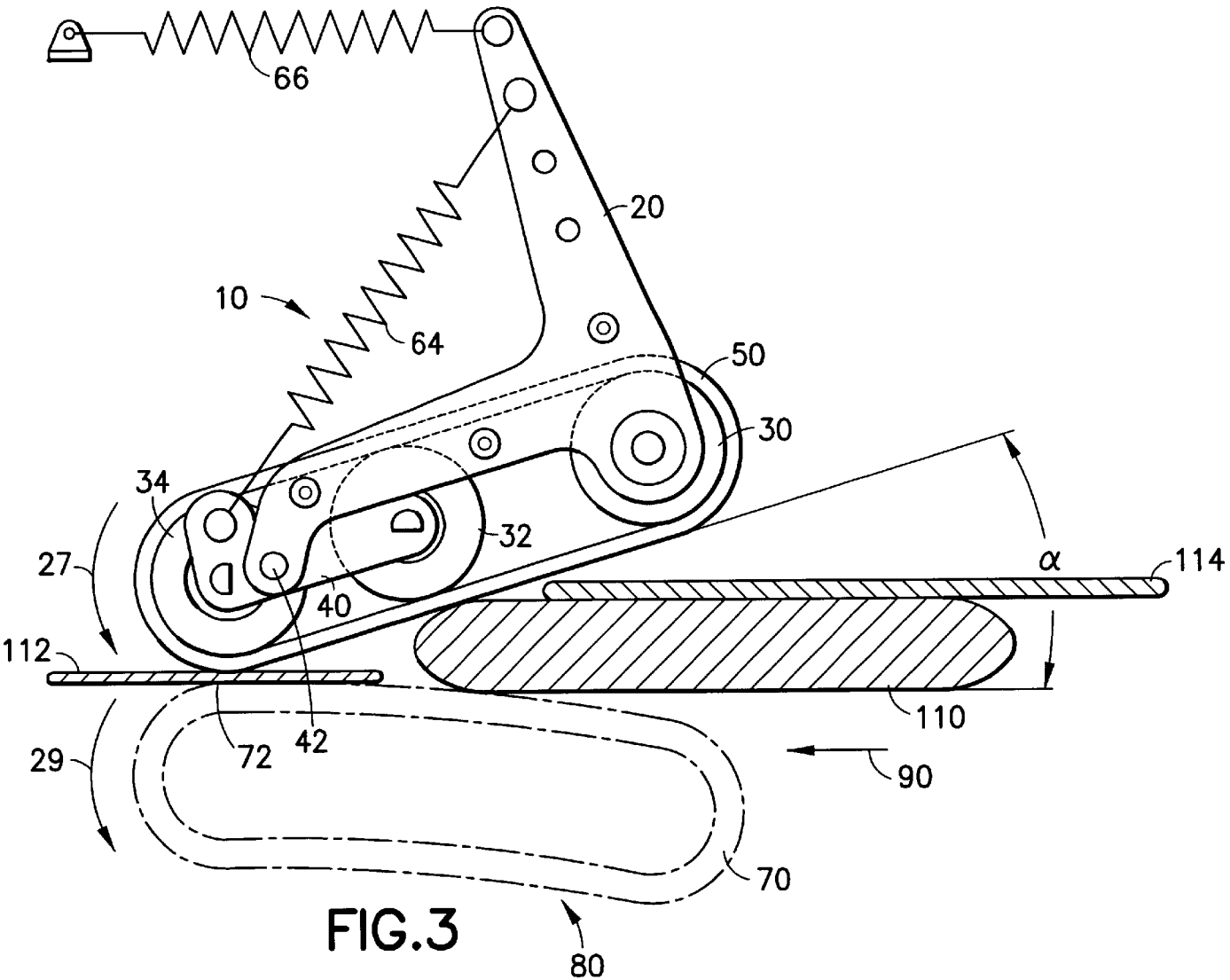
FIG. 3 shows the open position for the middle pulley.

FIG. 3 shows the open position for the middle pulley 32. As shown in FIG. 3, the ingestion angle $\alpha$ is widened as the middle pulley 32 is pushed further away from the feed module by a thick mailpiece 110 coming from the upstream direction. As the middle pulley 32, the downstream pulley 34 and the upstream pulley 30 are constrained by the endless belts 50, these pulleys are aligned substantially in a straight line when the ingestion angle $\alpha$ is fully opened. The largest ingestion angle $\alpha$ possible, according to the preferred embodiment of the present invention, is substantially equal to 17.1 degrees. But the largest ingestion angle $\alpha$ can be larger or smaller than 17.1 degrees. The largest ingestion angle $\alpha$ is referred to as the open ingestion angle and the position of the middle pulley 32 in this situation is referred to as the open position. It should be noted that even when the ingestion angle $\alpha$ is pushed open by the thick mailpiece 110, the separation nip at the point 72 still has positive control over a previous mailpiece 112, which can be a thin piece or a thick piece. When the middle pulley 32 is pushed further away from the feed belt, the downstream pulley 34 is pushed toward the feed module 80, thereby increasing the nip forces of the separator 110. When the trailing edge of the thick mailpiece 110 has passed the middle pulley 32, the pivoting action causes the middle pulley 32 to move toward the feed belt 70. Consequently, the endless belts 50 come in contact with the next mailpiece 114 more quickly to begin separation of the next mailpiece 114.

Figure 4:
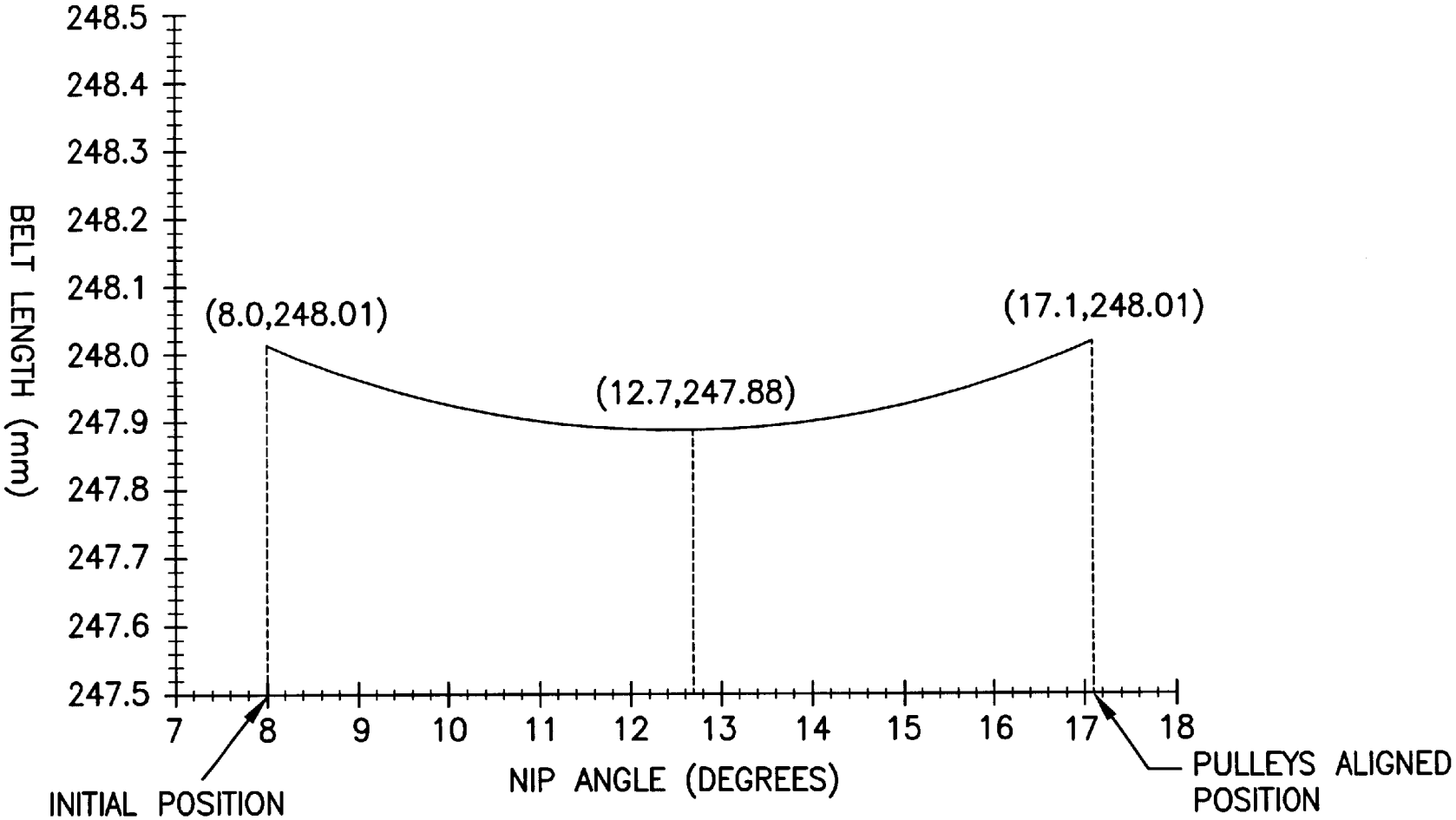
FIG. 4 shows the relation between the belt length and the position of the floating middle pulley expressed in terms of the ingestion angle.

FIG. 4 shows the relation between the belt length and the position of the middle pulley expressed in terms of the nip (ingestion) angle. As shown in FIG. 4, the initial ingestion angle $\alpha$ is substantially equal to 8 degrees when the idler, or the middle pulley 32, is at its initial position (see FIG. 2). At that idler position, the length of the endless belts 50 (see FIG. 2) is substantially equal to 248 mm (9.76"). When the middle pulley 32 is pushed further away from the initial position, the pivoting bracket 40 rotates accordingly and the belt length is slightly reduced. When the pulleys 30, 32 and 34 are in line with each other as the middle pulley 32 is operated at the open position (see FIG. 3), the open ingestion angle $\alpha$ is substantially equal to 17.1 degrees, and the length of the endless belts 50 is substantially equal to 248 mm. When the ingestion angle $\alpha$ is approximately at the midpoint between the initial angle and the open angle, the length of the endless belt is the smallest, about 247.88 mm, or 0.13 mm smaller than the largest length. The variation in the length of the endless belts 50 is less than 0.05%. Thus, not only can a constant belt length be maintained at the initial and the open positions, but the belt length throughout the entire operating of the ingestion angle $\alpha$ is substantially the same. This feature keeps constant tension on the endless belts 50 and helps prevent the belts 50 from slipping.

Although the invention has been described with respect to a preferred embodiment thereof, it will be understood by those skilled in the art that the foregoing and various other changes, omissions and deviations in the form and detail thereof may be made without departing from the spirit and scope of this invention. For example, the motions of the two pulleys 32 and 34 can be coupled to produce the desired change in the belt path-length using a number of different means. The specific geometry of the pivoting bracket 40, as shown in FIGS. 1–3, produces a path-length that has a specific relationship with the idler position is shown in FIG. 3. FIG. 3 has been developed based upon the kinematics of this specific linkage. However, those skilled in the art can produce the same kinematics relationship, or alternative relationship, by using similar linkages or kinematics equivalents. Equivalent mechanisms can be envisioned using cams, flexures and gears. This invention encompasses all such means, to produce a simple, cost-effective method of mounting and driving a retard belt for the optimal control and distribution of forces in a separator nip.

What is claimed is:

1. In an apparatus for singulating respective mailpieces fed thereto from an upstream direction, wherein a feed module is used to move the fed mailpieces toward a downstream direction against a retarding force and wherein the feed module has a downstream end and an upstream end and each mailpiece has a thickness, a retard module to form a separation nip with the feed module for ingesting mailpieces and to provide the retarding force, said retard module comprising:

at least one first-end pulley, one middle pulley and one second-end pulley; a frame having an upstream end and a downstream end for rotatably mounting the first-end pulley at the upstream end of the frame;

a bracket for rotatably mounting the middle pulley and the second end pulley, wherein said bracket is pivotally mounted about a pivoting point at the downstream end of the frame; and at least one belt for driving the first-end pulley, the middle pulley and the second-end pulley;

wherein the downstream end of the feed module and the belt at the downstream end of the frame form the separation nip and the middle pulley is positioned relative to the feed module to define an ingestion angle, and wherein the bracket allows the middle pulley and the second-end pulley to rotate in order to adjust the ingesting angle in accordance with the thickness of the mailpiece entering the separation nip;

wherein the middle pulley is located substantially between the first end pulley and the second end pulley; the middle pulley has a first rotating axis and the second-end pulley has a second rotating axis; and wherein the distance between the first rotating axis and the pivoting point is longer than the distance between the second rotating axis and the pivoting point.

2. The retard module of claim 1, wherein the ingestion angle is smallest when the middle pulley is at a first location adjacent to the feed module when no mail is entering the separation nip, and the ingestion angle is largest when the middle pulley is pushed further away from the feed module by a mailpiece entering the separation nip such that the middle pulley, the first-end pulley and the second-end pulley are in line with each other, and the middle pulley is said to be located at a second location.

3. The retard module of claim 2, wherein the ingestion angle is substantially equal to 8 degrees when the middle pulley is at the first location.

4. The retard module of claim 2, wherein the ingestion angle is substantially equal to 17.1 degrees when the middle pulley is at the second location.

5. The retard module of claim 2, wherein the belt has a length and wherein the length of the belt when the middle pulley is at the first location is substantially equal to the length of the belt when the middle pulley is at the second location.

6. The retard module of claim 5, wherein the length of the belt is smaller when the middle pulley is between the first location and the second location than the length of the belt when the middle pulley is at the first location.

7. The retard module of claim 5, wherein the length of the belt is substantially the same when the middle pulley is between the first location and the second location as the length of the belt when the middle pulley is at the first location.

8. The retard module of claim 1, wherein the first-end pulley is a driven pulley.

9. The retard module of claim 1, wherein the second-end pulley and the middle pulley are idlers.

10. The retard module of claim 1 further comprising means, engaged between the frame and the bracket, for urging the middle pulley to move toward the feed module.

11. The retard module of claim 1, wherein the frame has an extended portion extending from the downstream end of the frame and away from the feed module, the retard module further comprising a spring engaging the extended portion of the frame with the bracket adjacent the second-end pulley for urging the middle pulley to move toward the feed module.

12. The retard module of claim 1 further has means for urging the downstream end of the retard module to move toward feed module so as to provide a nipping force at the nip.

13. A retard module having an upstream section and a downstream section wherein the downstream section forms a separation nip with a feed module in a mailpiece separator for singulating mailpieces wherein each mailpiece has a thickness, said retard module comprising:

a frame having an upstream end adjacent to the upstream section and a downstream end adjacent to the downstream section;

at least one upstream pulley movably mounted on the upstream end of the frame;

at least one downstream idler movably and operatively connected to the downstream end of the frame;

at least one belt forming an endless loop to link the downstream pulley to the upstream pulley for motion;

at least one middle idler located within the endless loop, wherein the middle idler is located substantially between the upstream pulley and the downstream idler and is in contact with the endless loop adjacent to the feed module; and a bracket having a first end for pivotably mounting the downstream idler and an opposing second end for mounting the middle idler;

wherein the separation nip has an ingestion angle defined by the endless loop adjacent to the feed module and the feed module near the separation nip;

wherein the middle idler is allowed to be pushed further away from the feed module by an incoming mailpiece thereby changing the ingestion angle according to the thickness of the incoming mailpiece;

wherein the bracket is pivotably mounted at a pivot point between the first end and the second end to the downstream end of the frame, so as to allow the downstream idler and the middle idler to rotate about the pivot point when the middle idler is pushed further away from the feed module by the incoming mailpiece;

wherein the downstream idler has a first rotating axis and the middle idler has a second rotating axis and wherein the distance between the first rotating axis and the pivot point is shorter than the distance between the second rotating axis and the pivot point.

14. The retard module of claim 13 further comprising means for movably mounting the middle idler so as to allow the middle idler to be pushed further away from the feed module by the incoming mailpiece.

* * * * *